US005881965A

United States Patent [19]

Doell et al.

[11] Patent Number: 5,881,965

[45] Date of Patent: Mar. 16, 1999

[54] CHANGING DEVICE IN A PACKAGING MACHINE FOR A STORAGE ROLLER HAVING THEREON A FOIL STRIP

[75] Inventors: Erich Doell, Hungen; Werner Schneider, Hohenahr; Walter Baur, Gruendau, all of Germany

[73] Assignee: Rovema Verpackungsmaschinen GmbH, Fernwald, Germany

[21] Appl. No.: 886,418

[22] Filed: Jul. 1, 1997

[51] Int. Cl.[6] ..... B65H 16/06; B65H 23/00

[52] U.S. Cl. ..... 242/563.1; 242/596.1; 242/596.6

[58] Field of Search ..... 242/563.1, 596.6, 242/596.5, 596.1, 534.1, 596.4

[56] References Cited

U.S. PATENT DOCUMENTS

| | | | |
|---|---|---|---|
| 2,567,670 | 9/1951 | Iversen | 242/534.1 |
| 2,636,692 | 4/1953 | Picking | 242/563.1 |
| 2,741,440 | 4/1956 | Sutherland | 242/563.1 |
| 2,967,675 | 1/1961 | Markey | 242/563.1 |
| 3,323,740 | 6/1967 | Blessing | 242/563.1 |
| 4,434,947 | 3/1984 | Focke | 242/563.1 |
| 4,500,045 | 2/1985 | Whitaker et al. | 242/563.1 |
| 4,676,449 | 6/1987 | Buttermann | 242/596.6 |
| 4,840,321 | 6/1989 | Focke et al. . | |
| 5,133,511 | 7/1992 | Mack et al. | 242/563.1 |

*Primary Examiner*—John M. Jillions
*Attorney, Agent, or Firm*—Flynn, Thiel, Boutell & Tanis, P.C.

[57] ABSTRACT

The sleeve 6 of a storage roller 3 is held by two supporting pins 4, 5 on a changing device 1 of a packaging machine. One supporting pin 5 is connected to a drive motor 9 for rotation of the supporting pin 5. The supporting pin 5 can be moved together with the drive motor 9 in axial direction 11 by an adjusting device 10. The exact position of the storage roller 3 or of the foil strip 2 unwound from the storage roller 3 can be measured by a measuring mechanism 28. With the changing device 1, it is possible to exchange or exactly adjust a storage roller 3, or correct the course of the unwound foil strip 2.

20 Claims, 3 Drawing Sheets

CHANGING DEVICE IN A PACKAGING MACHINE FOR A STORAGE ROLLER HAVING THEREON A FOIL STRIP

FIELD OF THE INVENTION

The invention relates to a changing device in a packaging machine for a storage roller having thereon a foil strip, the changing device having two supporting pins inserted into a sleeve of a storage roller, and one of the supporting pins being axially movable.

BACKGROUND OF THE INVENTION

A changing device of this type is known from the DE-OS 3631205. It is disadvantageous in the known changing device that a storage roller mounted onto the supporting pin experiences a resistance from the bearings of the supporting pin during unwinding of foil from the storage roller. This resistance leads to an increased possibility of foil strip slippage relative to a transporting mechanism for the further transporting of the foil strip, and thus an inexact operation of a packaging machine.

SUMMARY OF THE INVENTION

The basic purpose of the invention is to equalize the resistance of the bearings supporting the supporting pins relative to the transporting mechanism for the further transporting of the foil strip, and thus to improve the precision of the foil transport. The changing of a storage roller is thereby not influenced by the axial movement of a supporting pin.

The purpose is attained by two supporting pins being placed into a sleeve of a storage roller. Accordingly, one pin is axially movable and is connected to a drive motor for rotation of the supporting pin. The supporting pin and the drive motor are movable in an axial direction by means of an adjusting device.

The changing device of the invention has the advantage that the resistance of the bearings of the supporting pins against the transporting mechanism for further transporting the foil strip is equalized by supporting pin being driven by the drive motor. The drive motor rotates the storage roller steadily through the supporting pin, and in such a manner that the unwinding of the foil occurs synchronously with the operation of the transporting mechanism. The frictional forces originating at the bearings of the supporting pins are compensated for by the output of the drive motor. The transporting mechanism thus does not experience a hold-back force from the storage roller and bearings, thus minimizing slippage at the transporting mechanism.

Because of this and also because of the inertial moment of the storage roller, the precision of the foil transport is improved. Since the supporting pin together with the drive motor can be moved in an axial direction by means of an adjusting device, the possibility of changing a storage roller through axial movement of the supporting pin is not altered. The drive motor is moved together with the supporting pin and can drive the supporting pin independently of the position of movement. Thus it is possible to also easily and quickly insert storage rollers having different axial dimensions.

If the adjusting device has an adjusting motor, then the adjusting device moves by means of a threaded rod engaged by threads of a connector in the axial direction. If the drive motor is connected to the connector, the connector can be moved together with the drive motor and the movable supporting pin in an axial direction by the adjusting motor.

The adjusting motor must merely be driven in short intervals for this movement. Whereas during one direction of rotation of the adjusting motor, the supporting pin is moved into the sleeve of the storage roller. The supporting pin is pulled out of the sleeve during the opposite direction of rotation of the adjusting motor. Depending on the thread pitch and the motor speed, the operation of movement occurs with a greater or lesser speed. The movement is particularly exact when a servomotor is used as the adjusting motor.

The stable positioning of the drive motor, also during its movement, is achieved when the drive motor is connected to a bearing, and the bearing is aligned and adapted to move the drive motor in an axial direction. An exact positioning and stabilization of the drive motor has the same effect on the supporting pin and thus on the storage roller. A continuously exactly-positioned storage roller enables an exact foil traveling course on the packaging machine. Alternatively to the drive motor being connected to the bearing, it is also possible for the connector to be connected to a corresponding bearing. The same advantages are achieved with the connector being connected to the bearing as in the case of a bearing being connected to the drive motor. A journal bearing has the advantage that it is strong and can be manufactured in a simple manner.

The supporting pin is inserted into a sleeve of a storage roller when the supporting pin has a conical shape.

A further simplification for the manual exchange of an empty sleeve for a new storage roller is achieved when a second supporting pin is also movable in the axial direction. By moving both supporting pins away from the sleeve, the sleeve can be removed in a radial direction even when only a relatively small path of movement is provided for the supporting pin moved by a motor. The second supporting pin rotates with the driven sleeve, and is axially movable also during its rotation if it is axially connected to a round rod, and the rod is held in a cylindrical bearing, for example a journal bearing. The rod and the cylindrical bearing are strong, easily manufacturable components.

If a damping member damping the movement of the second supporting pin in the axial direction is provided on the second supporting pin, then a constant pressure of the supporting pins against the sleeve results. In addition, the damping member improves the contact between the sleeve and the supporting pins. The pressure is thereby independent of the exact axial position of the sleeve when the damping member is a pneumatic cylinder.

If a mechanism for measuring the edge of the foil, which measuring mechanism is aligned radially with respect to a face of the storage roller, is provided, and the mechanism is connected through a line to a governor of the motor, then it is possible for the mechanism to measure the exact position of the edge of the storage roller. The governor effects a position correction in the case of an incorrect position by driving the motor for a corrected axial movement. An edge of the foil wound up on the sleeve rests on a face of the storage roller. However, the storage roller could also be moved in accordance with the measured values of an edge position of the foil strip measured at a different point along the travel of the foil strip in order to achieve in this manner a path correction of the foil strip in the packaging machine.

A simple and reliable mechanism for measuring the edge of the foil is achieved, if two parallel extending measuring beams originate from the mechanism. An exact position exists if only one measuring beam detects the presence of the foil. If both measuring beams register a foil or do not register a foil, the storage roller must then be moved in one direction or the other opposing direction.

If a scale for a rough adjustment of the storage roller is provided radially adjacent to a face of the storage roller, and if furthermore a mechanism for a manual approximate adjustment of the storage roller is connected to the motor, then it is possible during the exchange of an empty sleeve for a new storage roller to initially approximately position the storage roller before the storage roller with the mechanism for gripping the edge of the foil is axially moved into its desired position. The governor for adjusting the desired position can be a Fuzzy governor. The Fuzzy governor regulates the desired position based on stored empirical values. In particular, the empirical values permit a careful counter-control upon a recognized, incorrect course of the foil strip.

If the adjusting motor, or the drive motor has a reduction gear, the rotation of the storage roller and the movement occurs sufficiently slowly and/or sufficiently exactly.

The changing device is of importance in particular for vertical tubular bagging machines. A simple exchanging operation, a continuous rotation movement of the storage roller and a reliable correction operation is especially advantageous for the traveling path of the foil strip within these packaging machines.

BRIEF DESCRIPTION OF THE DRAWINGS

One exemplary embodiment of the invention will be described in greater detail hereinafter in connection with the figures, in which.

DETAILED DESCRIPTION

Figure 1:
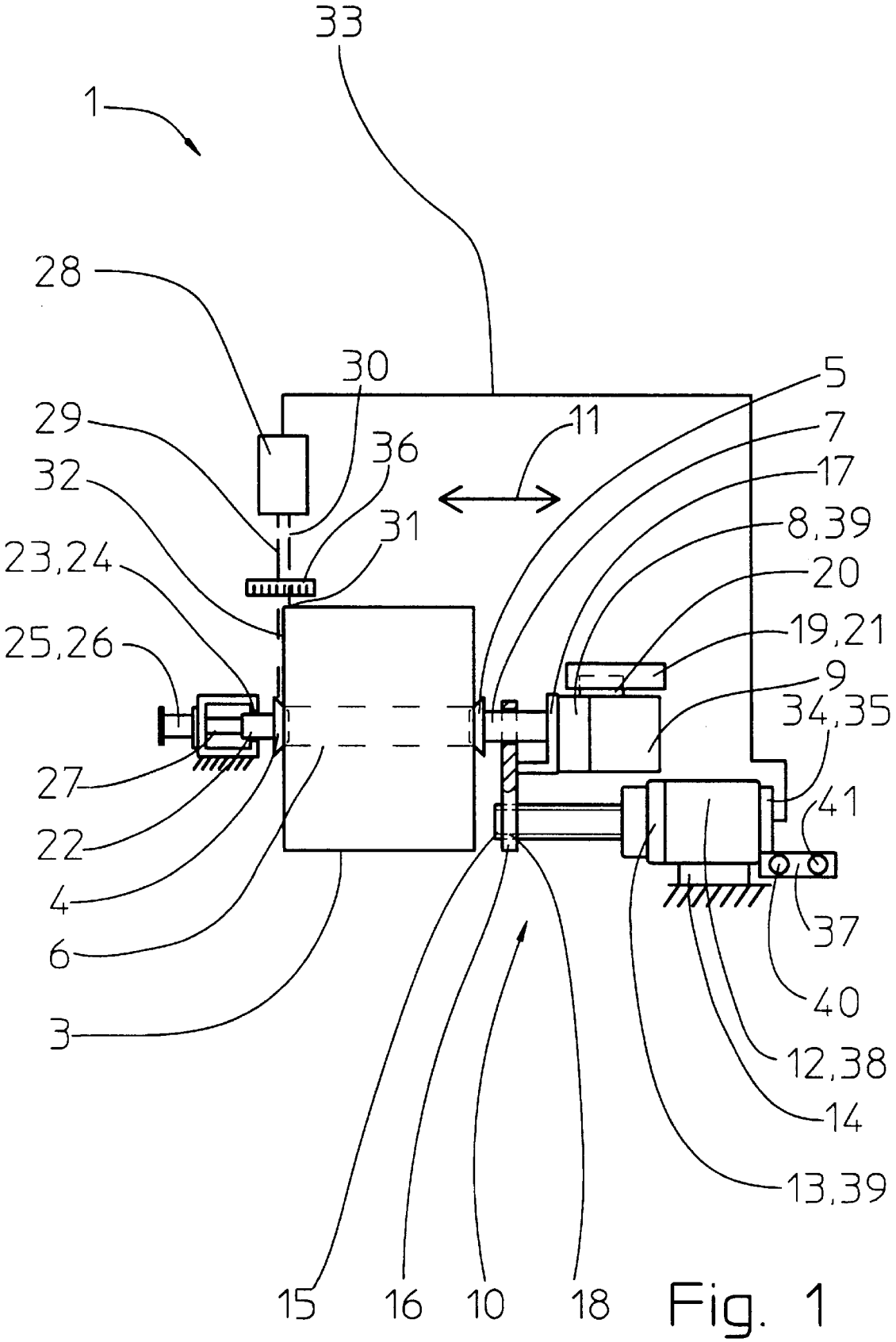
FIG. 1 is a schematic side view of a changing device of the invention with two conical supporting pins inserted into a sleeve of a storage roller, whereby one supporting pin is connected with a drive motor for rotation of the supporting pin, said supporting pin together with the drive motor can be moved in an axial direction by means of a motor of an adjusting device, a damping member connected to the other supporting pin, and a mechanism for measuring the edge of the foil, which mechanism is connected to the motor through a governor.
Figure 3:
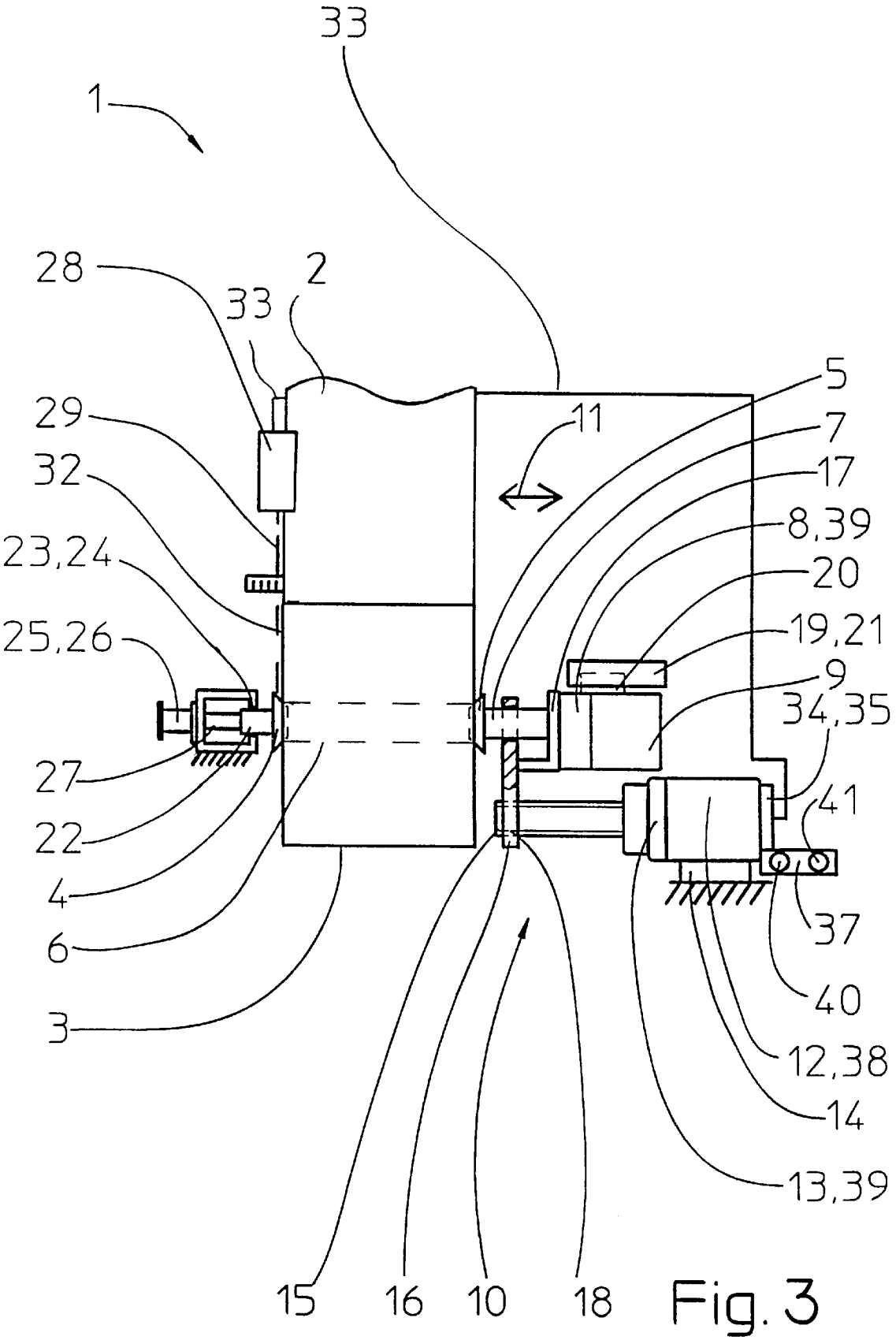
FIG. 3 is a view similar to FIG. 1 and additionally shows the foil strip.

A foil strip 2 is wound around a storage roller 3 in a changing device 1 of a packaging machine (FIGS. 1 and 3). Two supporting pins 4, 5 of the changing device 1 are inserted into a sleeve 6 of the storage roller 3. One supporting pin 5 is connected to a drive motor 9 through a shaft 7 and a gear unit 8. The drive motor 9 rotatably drives the supporting pin 5, thereby also rotatably driving the storage roller 3 and the second supporting pin 4. The foil strip 2 is unwound from the storage roller 3 during the rotation of the storage roller 3.

Figure 2:
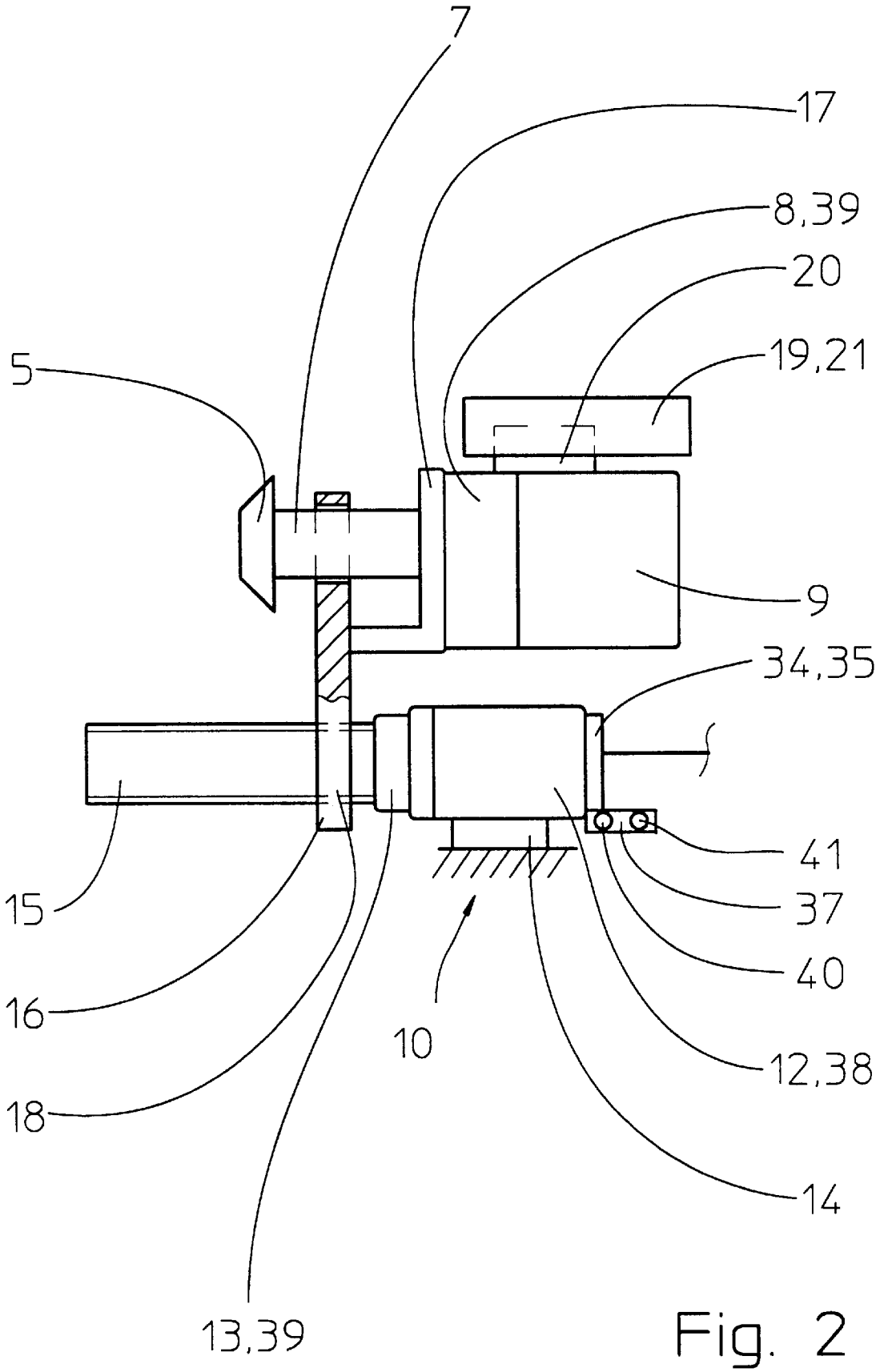
FIG. 2 is an enlarged side view of a section of FIG. 1, however, with the supporting pin in an axially moved position.

The supporting pin 5 can be moved in an axial direction 11 (FIG. 1) together with the drive motor 9 by means of an adjusting device 10 (FIG. 2). The adjusting device 10 has an adjusting motor 12 with a gear unit 13. The adjusting motor 12 is stationarily secured on a fixed plate 14 of the packaging machine and moves a connector 16 by means of a threaded rod 15. Since the drive motor 9 is rigidly connected to the connector 16 through the gear unit 8 and a mounting 17, the adjusting motor 12 through its rotation moves the connector 16 together with the mounting 17, the gear unit 8, the drive motor 9, the shaft 7 and the supporting pin 5 in the axial direction 11. The threaded rod 15 rotated by the motor 12 runs in a thread 18 of the connector 16. The connector 16 may be in the form of a rigid plate threadedly attached at one end to the threaded rod 15 and fixedly secured to the mounting 17 adjacent the other end.

In order to stabilize the drive motor 9, it is connected to a bearing 19 by means of a glide element 20. The bearing 19 is aligned to allow movement of the drive motor 9 in the axial direction 11. The bearing 19 is a journal bearing 21.

The supporting pins 4, 5 have a conical shape. The second supporting pin 4 can be axially moved with a mechanism, which can be moved manually or moved by a motor. The supporting pin 4 is connected to a round rod 22. The rod 22 is held by a cylindrical bearing 23. The rod 22 can be rotated in the stationary bearing 23. The bearing 23 is a journal bearing 24 limiting radial movement of the rod 22. A pneumatic cylinder 26, which dampens the movement of the supporting pin 4 in the axial direction 11, is provided as a damping member 25 on the supporting pin 4. The pneumatic cylinder 26 provides a constant pressure of the supporting pin 4 against the sleeve 6. The supporting pin 4 can also be moved in the axial direction 11 against the force of the pneumatic cylinder 26 when an exchange of an empty sleeve 6 for a sleeve 6 storing foil therein is required.

A mechanism 28 for measuring the edge of the foil is provided on the changing device 1. The mechanism 28 also measures the position of the foil strip 2 and storage roller 3. Two measuring beams 29, 30 extending parallel to one another originate from the mechanism 28. The beams 29, 30 may be beams emitted from electro-optical devices, for example lasers and LED's, or other suitable measuring light beam producing devices. When the storage roller 3 is correctly positioned, only one of the measuring beams 30 hits or impinges the edge 31 of the foil strip 2, and the other measuring beam 29 does not hit (impinge) the foil strip 2 or the storage roller 3 thereby passing the face 32 of the storage roller 3. When the storage roller 3 is incorrectly positioned, namely when both measuring beams 29, 30 hit the (impinge) the foil strip 2 or storage roller 3 or pass the same, the signals emitted by the mechanism 28 for measuring the edge of the foil are forwarded through a line 33 to a governor 34. The governor 34 controls the adjusting motor 12 such that the adjusting motor 12 is operated so that the storage roller 3 is moved into a correct position. The line 33 may be an electrical communication line.

The mechanism 28 for measuring the edge of the foil and the adjusting device 10 can be utilized for different functions. Whereas the adjusting device 10 can be principally utilized for changing the storage roller 3, for exactly positioning the storage roller 3, or for continuously changing the position of the storage roller 3 to compensate for errors during the run of the foil strip 2 as they occur in vertical tubular bagging machines, the function of the mechanism 28 depends on the place of use of said mechanism 28. It is advantageous on the vertical tubular bagging machine to arrange the mechanism 28 on the unwound foil strip 2 in order to measure the traveling course of the foil strip 2, and in order to compensate for an incorrect strip traveling course by means of an axial movement of the storage roller 3. Experimental values stored in the governor 34 designed as a fuzzy governor 35 having a memory device, can be utilized for this purpose. The fuzzy governor 35 may be an integrated circuit device or electrical controller which may employ fuzzy logic that is logic based on operational parameters of the foil strip.

Adjacent and radial to the face 32 of the storage roller, there is provided a scale 36 for a rough adjustment of the storage roller 3. The position of the storage roller 3 can be recognized on the scale by a mechanic. By means of operating buttons 40, 41 of a mechanism 37 for a manual rough or approximate adjustment of the storage roller 3, it is then on short notice possible to drive the adjusting motor 12 in the one direction or in the opposite direction, which causes the storage roller 3 to be shifted a short distance into the one or other direction along the axial direction 11. The adjusting motor 12 is a servomotor 38 and has, just like the drive motor 9, a reduction gear 39.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A changing device of a packaging machine for a storage roller having thereon a foil strip, comprising a storage roller having a sleeve and two supporting pins positioned in said sleeve, and one of said supporting pins being axially movable, a drive motor for rotating said one supporting pin, an adjusting means for moving said one supporting pin and said drive motor together in an axial direction, and a mechanism for measuring a position of the edge, said mechanism including means for producing first and second measuring light beams, said first beam extending past an end face of said storage roller and said second beam impinging the edge with said storage roller in a correct position, and one of said first beam impinging the storage roller and said second beam nonimpinging said edge with said storage roller in an incorrect position, whereby said adjusting means adjusts said storage roller in response to one of said first and second beams if said storage roller is in the incorrect position.

2. The changing device according to claim 1, wherein said adjusting means has a stationary motor, and a rotatable threaded rod connected to said stationary motor, a connector having a thread receiving said threaded rod, said connector being adapted to move in said axial direction in response to rotation of said threaded rod, and said drive motor is connected to said connector.

3. The device according to claim 2, wherein said drive motor includes a mounting, said connector is connected to said mounting, and a bearing supports said drive motor for movement in said axial direction.

4. The changing device according to claim 2, wherein one of said stationary motor and said drive motor has a reduction gear.

5. The changing device according to claim 1, wherein said drive motor is connected to a bearing, and said bearing is aligned for allowing movement of said drive motor in said axial direction.

6. The changing device according to claim 5, wherein said bearing is a journal bearing.

7. The changing device according to claim 1, wherein a second of said supporting pins is movable in said axial direction.

8. The changing device according to claim 7, wherein a damping member is provided on said second supporting pin and damps movement of said second supporting pin in said axial direction, and said adjusting means moves said drive motor, one supporting pin and sleeve against said second supporting pin and damping member, said damping member yielding in one direction and continuously urges said second supporting pin in a second direction toward said one supporting pin so as to hold said sleeve between said one and second supporting pins.

9. A packaging material supply device for a packaging machine, comprising:

a storage roller including an elongate sleeve and packaging material wound on said sleeve, said sleeve extending in an axial direction;

first and second support pins receivable in respective ends of said sleeve, said first and second pins being adapted to rotatably support said storage roller, said second support pin being freely rotatable and displaceable in the axial direction to correctly position said storage roller for unwinding said packaging material from said sleeve;

a damping member connected to said second support pin for retarding movement of said second support pin in said axial direction;

a drive motor having a rotatable shaft, said first support pin being secured to said shaft and being rotatable therewith, said shaft and first support pin rotating said storage roller for unwinding said packaging material therefrom;

a bearing supporting said drive motor for movement in said axial direction; and an adjustment device selectively axially positioning said drive motor, said shaft and first support pin to position said storage roller in a correct position, said second support pin being axially displaced by one of said damping member toward said drive motor and said adjustment device away from said drive motor against a retarding force of said damping member, so that said unwound packaging material is correctly positioned.

10. The device according to claim 9, wherein said first and second supporting pins have a conical shape.

11. The device according to claim 9, wherein a round rod is axially connected to said second supporting pin, and a cylindrical bearing rotatably holds said rod.

12. The device according to claim 11, wherein said cylindrical bearing is a journal bearing radially limiting movement of said rod.

13. The device according to claim 9, wherein said damping member is a pneumatic cylinder.

14. The device according to claim 9, wherein a mechanism for measuring an edge of the packaging material is aligned toward an edge of said unwound packaging material, and said measuring mechanism is connected through a line to a governor of said adjustment device.

15. The device according to claim 14, wherein two parallel measuring beams for detecting the edge of said packaging material extend from said measuring mechanism.

16. The device according to claim 14, wherein a scale is positioned radially adjacent to a face of said storage roller for an approximate axial adjustment of said storage roller, and wherein a manual mechanism for rough adjusting of said storage roller is connected to said adjustment device.

17. The device according to claim 14, wherein said governor includes a fuzzy logic circuit.

18. The changing device according to claim 9, wherein said stationary motor is a servomotor.

19. The device according to claim 9, wherein said adjustment device includes a position measuring device producing first and second measurement light beams, in a correct position of said storage roller said first beam extends past said face of said storage roller and said second beam impinges said packaging material, in an incorrect position of said storage roller one of said first beam impinges said storage roller and said second beam extends past said packaging material, said measuring device produces an electrical signal in response to a measured position of the storage roller; and a communication line transmits said signal in said adjustment device to effect adjustment of the drive motor and the storage roller into the correct position.

20. The device according to claim 19, wherein said adjustment device includes an axially stationary motor, a threaded rod rotatably secured to the axially stationary motor, and a connector, said connector is threadedly secured to said threaded rod and fixed to said drive motor so that rotation of said threaded rod axially positions said drive motor, and said adjustment device includes a logic circuit for controlling operation of said stationary motor in response to said signal.

* * * * *